US008665676B2

(12) United States Patent
Sarchi et al.

(10) Patent No.: US 8,665,676 B2
(45) Date of Patent: Mar. 4, 2014

(54) ACOUSTIC RADIATING MEMBRANE FOR A MUSIC BOX OR STRIKING WATCH

(75) Inventors: Davide Sarchi, Renens (CH); Jerome Favre, Les Bioux (CH); Nakis Karapatis, Premier (CH)

(73) Assignee: Montres Breguet SA, L'Abbaye (CH)

( * ) Notice: Subject to any disclaimer, the term of this patent is extended or adjusted under 35 U.S.C. 154(b) by 177 days.

(21) Appl. No.: 13/285,542

(22) Filed: Oct. 31, 2011

(65) Prior Publication Data

US 2012/0140603 A1 Jun. 7, 2012

(30) Foreign Application Priority Data

Dec. 2, 2010 (EP) ..... 10193425

(51) Int. Cl.
*G04B 21/00* (2006.01)

(52) U.S. Cl.
USPC ..... 368/272

(58) Field of Classification Search
USPC ..... 368/272, 243–245, 315, 72; 367/138, 367/158; 84/422.3, 422.4
See application file for complete search history.

(56) References Cited

U.S. PATENT DOCUMENTS

| | | | | |
|---|---|---|---|---|
| 2,786,326 | A * | 3/1957 | Junghans et al. | 368/244 |
| 3,732,686 | A * | 5/1973 | Zaugg | 368/37 |
| 3,777,472 | A * | 12/1973 | Iinuma | 368/255 |
| 3,906,713 | A * | 9/1975 | Suda et al. | 368/255 |
| 4,258,432 | A * | 3/1981 | Zafferri et al. | 368/250 |
| 2007/0163424 | A1 * | 7/2007 | Mintz | 84/422.3 |

FOREIGN PATENT DOCUMENTS

| | | | |
|---|---|---|---|
| CH | 581 860 | B5 | 3/1976 |
| CH | 688 927G | A3 | 6/1998 |
| EP | 1 063 632 | A1 | 12/2000 |
| EP | 1 795 978 | A2 | 6/2007 |

OTHER PUBLICATIONS

European Search Report, dated May 27, 2011.

* cited by examiner

*Primary Examiner* — Edwin A. Leon
(74) *Attorney, Agent, or Firm* — Sughrue Mion, PLLC

(57) ABSTRACT

The acoustic radiating membrane (1) is for assembly in a music box or a striking watch. The membrane is made with at least one area of asymmetrical shape, formed in the material of the membrane or with at least one area of asymmetrical shape having a different thickness from the general thickness of the membrane. It preferably includes two asymmetrical areas of elliptical shape (2, 3) which are partly superposed and have a different thickness from each other. The two ellipses (2, 3), preferably hollowed out of the membrane, are off-centre in relation to each other.

15 Claims, 3 Drawing Sheets

ACOUSTIC RADIATING MEMBRANE FOR A MUSIC BOX OR STRIKING WATCH

This application claims priority from European Patent Application No. 10193425.5 filed 2 Dec. 2010, the entire disclosure of which is incorporated herein by reference.

FIELD OF THE INVENTION

The invention concerns an acoustic radiating membrane for a music box, such as a musical watch, or a striking watch.

The invention also concerns a watch, which includes an acoustic radiating membrane. The watch includes a watch case essentially formed of a middle part and a back cover removably secured in a sealed manner to the middle part. A crystal is arranged on the opposite side to the back cover to close said case in a sealed manner. A timepiece movement is held inside the watch case and provided with a striking mechanism that can be actuated at determined times to produce a sound or music. At least one acoustic radiating membrane is connected to the case to radiate the sound produced by the striking mechanism towards the exterior of the case.

BACKGROUND OF THE INVENTION

In the field of horology, a timepiece movement of conventional architecture may also include a striking mechanism for generating a sound or music. The gong of the striking watch or the pin-barrel of the musical watch are arranged inside the watch case. Thus, the vibrations of the gong or the pin-barrel tongues are transmitted to the external parts of the watch. These external parts are, for example, the middle part, the bezel, the crystal and the back cover of the watch case. These large parts start to radiate sound into the air under the effect of the transmitted vibrations. When a sound is produced either by a gong struck by a hammer, or by one or more vibrating pin-barrel tongues, these external parts are capable of radiating the produced sound into the air.

In a conventional striking or musical watch, acoustic efficiency, based on the complex vibro-acoustic transduction of the external parts, is low. In order to improve and increase the acoustic level perceived by the user of the striking or musical watch, the material, geometry and boundary conditions of the external parts must be taken into account. The configurations of these external parts are also dependent upon the aesthetic appearance of the watch and operating stresses, which may limit adaptation possibilities.

It is known in watchmaking technology to use an acoustic type membrane, which is dedicated to vibro-acoustic transduction, in a watch and particularly an electronic watch. To activate this type of membrane in an electronic watch, a piezoelectric element is, for example, placed on the membrane to cause it to vibrate, as mentioned in CH Patent No. 581 860. To prevent the acoustic radiation from the membrane from being lost in the watch, which must be sealed, a double back cover can be provided for the watch case, which must be open towards the exterior. In such case, the back cover of the watch case has one or more apertures for the transmission of sound from the vibrating membrane.

Generally, with the use of a conventional acoustic radiating membrane, a problem of frequency bandwidth exists. In the case of a striking watch with minute repeaters, an alarm or even a quartz alarm, excellent results may be obtained by amplifying a single dominant frequency, tuned with the exciter. However, if the acoustic membrane has to be fitted to a music box, the frequencies to be radiated efficiently must typically range between 1 kHz and 4 kHz. The acoustic response of the membrane must therefore be relatively uniform within this frequency range. However, standard uniform membranes never succeed in fulfilling this condition, since the level of response within this frequency range is generally very inhomogeneous.

In a standard striking watch, which is, for example, fitted with an acoustic membrane, the membrane is sandwiched between part of the middle case and the back cover of the watch. In the case of a luxury watch, the back cover may be made of a precious material, such as gold. A difference in electrochemical potential may occur on contact between the membrane, which is generally made of steel, with the gold back cover, especially in a humid environment. This is liable to contribute to the corrosion of said membrane where it is in contact with the gold back cover, which is another drawback. A corrosion resistant material must therefore be found which has no difference in potential with gold and low internal damping.

SUMMARY OF THE INVENTION

It is therefore an object of the invention to overcome the drawbacks of the aforementioned state of the art, by providing an acoustic radiating membrane for a music box or striking watch, made so as to provide the most uniform possible efficiency across the audible frequency band, essentially within the frequency range of 1 kHz to 4 kHz.

The invention therefore concerns an acoustic radiating membrane, which includes an acoustic radiating membrane for a music box or striking watch, wherein it is made with at least one area of circularly asymmetrical shape formed in the material of the membrane or with at least one area of circularly asymmetrical shape hollowed out of a part of the membrane or projecting from one part of the membrane.

Particular embodiments of the acoustic membrane are defined in the dependent claims 2 to 12.

One advantage of the acoustic radiating membrane according to the present invention lies in the fact that it is made with at least one area of asymmetrical shape, formed in the material of the membrane or with at least one area of asymmetrical shape having a different thickness from the general thickness of the membrane. It may include several areas of asymmetrical shape, which are hollowed out of the material of the membrane. There are preferably two hollowed out areas of different dimensions. A first area is machined, for example, by etching or hollowing out the membrane to obtain a first constant thickness, and a second area is machined in the membrane to obtain a second constant thickness, smaller than the first thickness. The two areas of asymmetrical shape are machined to define, for example, first and second ellipses as the asymmetrical shapes. These ellipses are shifted in relation to each other relative to the centre of the membrane and are partly superposed.

Owing to the fact that the ellipses are made in the membrane, twice as many natural vibration modes can be obtained for each ellipse compared to an area of circular shape. The number of natural modes within the audible frequency range is thus maximised, particularly between 1 kHz and 4 kHz. The overall response of the vibrating membrane is thus flattened by removing the circular symmetry and using an asymmetrical area of this type in the form of an ellipse seen in a plan view.

Advantageously, the membrane may be made of amorphous metal or metallic glass, or also of gold, or even brass or another material having similar density, Young's modulus and limit of elasticity. The arrangement of the asymmetrical areas may also increase the number of natural frequencies in the useful acoustic frequency band, i.e. between 1 kHz and 4 kHz, also in order to increase the overall acoustic level. With this type of membrane, enlargement of the acoustic range may be combined with very low internal damping, which provides very good acoustic efficiency.

The invention therefore concerns a watch, provided with an acoustic radiating membrane including a striking or musical watch, including a watch case, which has a middle part and a back cover having at least one lateral aperture, wherein the back cover is secured in a sealed and removable manner to the middle part, a crystal closing the case in a sealed manner, a watch movement held inside the watch case and provided with a striking mechanism capable of being actuated at determined times to produce one note or several notes, and at least one acoustic radiating membrane, which is arranged in the watch case Specific embodiments of the watch are defined and claimed herein.

BRIEF DESCRIPTION OF THE DRAWINGS

The objects, advantages and features of the acoustic radiating membrane for a music box or striking watch will appear more clearly in the following description given on the basis of at least one non-limiting embodiment, illustrated by the drawings, in which.

DETAILED DESCRIPTION OF THE INVENTION

In the following description, reference will mainly be made to the configuration of an acoustic radiating membrane to be fitted, in particular, to a music box, such as a musical watch, or striking watch.

Figure 1:
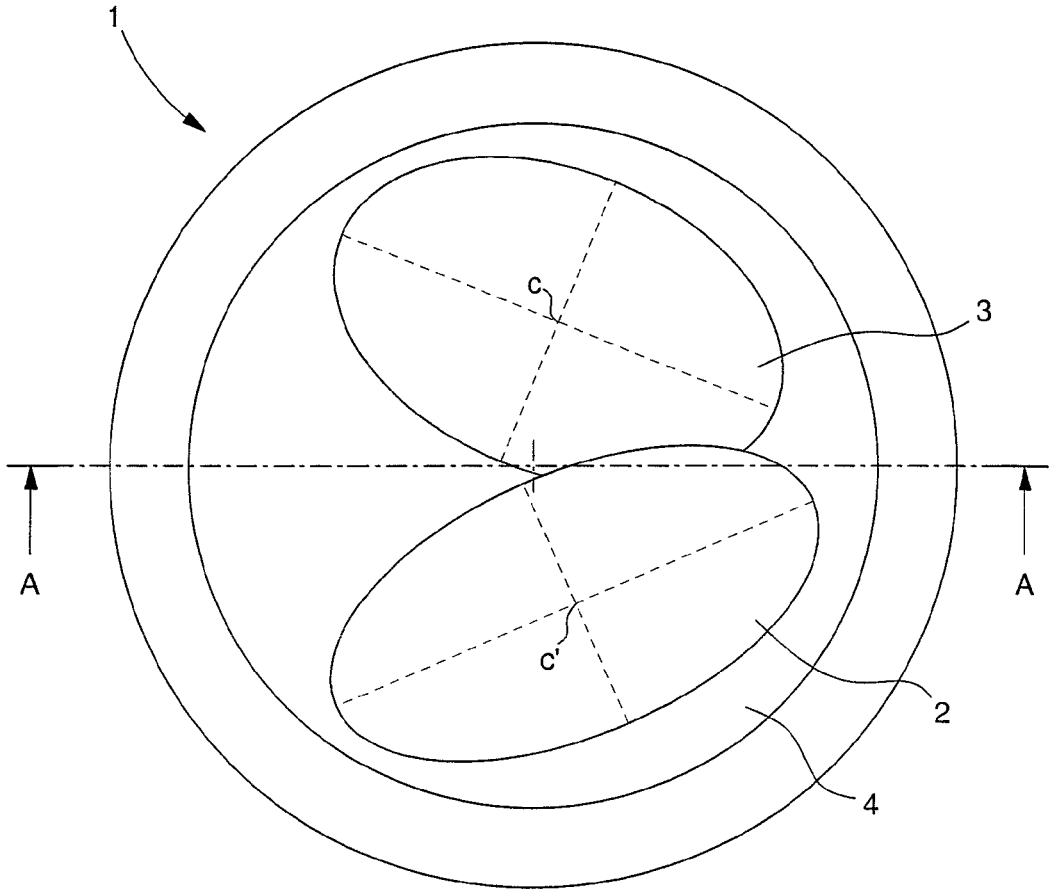
FIG. 1 shows a simplified, top view of the acoustic radiating membrane according to the invention.

FIG. 1 shows a top view of an acoustic radiating membrane 1 for a music box, such as a musical watch, or striking watch. In this embodiment, membrane 1 is made with inhomogeneous spatial thickness, i.e. it includes areas, which have been machined into the total thickness of the membrane. The machined areas each have a different uniform thickness. Seen in a top view, the hollowed out areas of different thickness have asymmetrical circular shapes. The asymmetrical shapes are preferably ellipses 2, 3 hollowed out of a bottom part 4 of a circular membrane 1, which may be dome-shaped, as explained hereinafter with reference to FIGS. 2 and 4. These ellipses 2, 3 are partly superposed. The presence of several asymmetrical circular areas considerably increases the number of natural vibration modes or frequencies. This thus increases the bandwidth, preferably between 1 kHz and 4 kHz and the uniformity of amplification within this audible frequency band.

As was observed during the acoustic radiation test of this type of membrane, optimally two asymmetrical areas 2, 3 are made in the thickness of membrane 1. These two areas, in the form of ellipses of different uniform thickness, have different dimensions or surfaces, yet are not directly dependent on the dimensions of the membrane. Membrane 1 may be a circular membrane having a diameter on the order of 40 mm at the edge and a diameter on the order of 31 mm at the bottom 4 thereof, by way of non-limiting example. These two areas of elliptical shape occupy a large part of the surface of the membrane seen in a plan view so as to increase the number of natural vibration modes within the desired audible frequency band between 1 kHz and 4 kHz.

The areas of elliptical shape are normally determined taking account of the following simplified formula of the frequency ω of the vibration modes of an elliptical membrane:

$$\omega^2_{n,m} \approx E \cdot h \cdot (n/b^2 + m/a^2)/(\rho \cdot (1-v^2))$$

where E is the Young's modulus, h is the thickness of the membrane, a and b are the semi-axes of the ellipse, ρ is the density of the material of the membrane, v is the Poisson coefficient (approximately on the order of 0.3), n and m are integer numbers, which number the vibration modes and represent the number of spatial nodes of the corresponding vibration of the membrane. The number of nodes in the direction of semi-axis a and semi-axis b is m−1, n−1 respectively. In the case of a mode indicated by n=2 and m=3, this corresponds to a vibration which has two nodes in the direction of semi-axis a, and one node in the direction of semi-axis b. In the case of a mode indicated by n=1 and m=1, there are no nodes in either direction of the semi-axes.

According to the aforementioned vibration frequency formula, the frequency increases with the square root of the Young's modulus E and thickness h, but conversely, decreases by increasing the semi-axes a and b, i.e. the surface of the ellipse. By way of comparison, for the same surface area and same thickness, and within the desired frequency range, an elliptical membrane has twice as many vibration modes compared to a circular membrane. It is therefore possible to flatten the overall frequency response by removing the circular symmetry of the membrane. The asymmetrical areas preferably in the form of ellipses 2, 3 of acoustic membrane 1 according to the invention, are configured such that the first natural vibration modes are within the audible frequency range between 1 kHz and 4 kHz. With ellipses of this type, better geometrical optimisation can be obtained than with other asymmetrical shapes.

It should be noted that a circular membrane of uniform thickness can withstand several natural vibration modes, which are defined by $k_N$. Each natural mode is characterized by a defined number of nodes N. Owing to the areas of different thickness, which are called $S_j$ with j ranging from 1 to n, and for each defined number of nodes N, several vibration modes $k_N^l$ are counted having this number of nodes. These modes differ from each other by their spatial shape and/or orientation in the plane of the membrane. The difference in energy between these modes depends upon the thickness and the shape of areas $S_j$ and may therefore be reduced as desired. This multiplication of modes in each energy range enables the response band of the membrane to be enlarged. To simplify the calculation and for reasons of practicality, the specific case where the areas of different thickness are two ellipses is considered here.

Owing to the fact that two ellipses are made in the membrane, for each defined number of nodes, there are four vibration modes, including two vibration modes per ellipse and not simply one vibration mode as for a conventional circular membrane. The number of modes within the audible frequency band is thus maximised. The overall response of the vibrating membrane is thus flattened by removing the circular symmetry and using an asymmetrical area of this type in the form of an ellipse seen in a plan view.

For typical watch dimensions, with the two areas of elliptical shape, it is possible to obtain better geometrical optimisation than with any other asymmetrical shape. If the size of each ellipse is sufficiently large relative to the size of the membrane, the first vibration modes have uniform amplification within the desired frequency band, for example between 1 kHz and 4 kHz. The overall acoustic level is also increased for the user to perceive notes radiated by the membrane of the music box or striking watch.

As described hereinbefore, circular membrane 1 may have a diameter equal to 40 mm at the edge thereof and a diameter equal to 31 mm at the bottom 4 thereof. It may be made of a material, such as zirconia based metallic glass, with a density equal to 5,100 kg/m3. The material used for the membrane may have a Young's modulus, which may vary between 97 and 110 GPa, whereas the limit of elasticity thereof may vary between 1.5 and 2.2 GPa. The maximum thickness of the membrane may be on the order of 0.3 mm, whereas the minimum thickness may vary between 0.1 mm and 0.2 mm, depending on the sound effects to be obtained. If the density is larger, whereas the Young's modulus is smaller, a membrane thickness of more than 0.3 mm may be allowed, but under these conditions, the membrane is less acoustically efficient.

The size of the first ellipse 2, which is hollowed out of bottom 4 of the membrane, is 12 mm for the semi-major axis and 6 mm for the semi-minor axis with a thickness of 0.15 mm. The size of the second ellipse 3, which is hollowed out of the bottom 4 of the membrane partly superposed on the first ellipse and intersected, is 11 mm for the semi-major axis and 7 mm for the semi-minor axis, with a thickness of 0.2 mm. The centres c, c' of the first and second ellipses 2, 3 may be shifted in relation to each other, for example by 13.5 mm and the angle between the large axes of the two ellipses may be on the order of 60°. If the two ellipses are of relatively similar size, the density of the vibration modes of the membrane is maximised within the desired audible frequency band. It is also possible to envisage adapting the thicknesses and surface of the ellipses according to the desired sealing, indeformability or deformability of the desired membrane.

Generally, the ratio between the semi axes of ellipses hollowed out of the membrane and the radius of the circular membrane must, in principle, be within the range of ⅔ to 1. The ratio between the two thicknesses of the ellipses must be within the range of ½ to ⅘. The minimum thickness must not be greater than ⅔ of the total thickness of the circular membrane.

Figure 2:
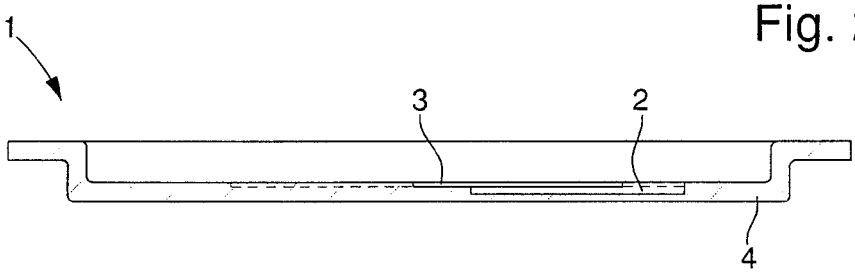
FIG. 2 shows a simplified, diametral cross-section along A-A of FIG. 1 of the acoustic membrane according to the invention.

FIG. 2 shows a diametral cross-section along A-A of FIG. 1 of the acoustic radiating membrane 1. This membrane may take the form of a dome with a bottom 4 and a peripheral edge for assembly, in particular, in a watch case as explained hereinafter with reference to FIG. 4. The elliptical asymmetrical areas 2 and 3 are made in the bottom 4 of membrane 1. Each area is hollowed out of the membrane with a different uniform thickness. It is also to be noted that the hollowed out areas may either be on the movement side or the external side of the membrane (not shown).

It is also to be noted that, instead of making asymmetrical areas 2, 3 by etching, milling or hollowing out the total thickness of membrane 1, it is possible to envisage making two elliptical areas on a membrane of minimal thickness, which are in excess thickness and intersect each other. A first area has a first thickness greater than the minimum thickness of the membrane and a second area has a second thickness greater than the first thickness of the first area. These areas of elliptical shape therefore form projecting portions on the membrane, whose asymmetrical shape provides the same advantages as those of the ellipses hollowed out of the membrane and explained hereinbefore. These areas may be obtained by the selective deposition of the same material as the basic material of the membrane. The material may be zirconia-based or platinum-based metallic glass, or also gold.

It is also to be noted that instead of making asymmetrical areas 2, 3 by etching, milling or hollowing our the total thickness of membrane 1, it is possible to envisage making a circularly asymmetrical membrane, by altering the physicochemical properties thereof locally and in a deterministic manner during fabrication or post-processing. This procedure enables uniform areas having circularly asymmetrical shapes to be made and thus multiplies the vibration modes and flattens the frequency response, in accordance with the same principles of physics explained hereinbefore.

Figure 3:
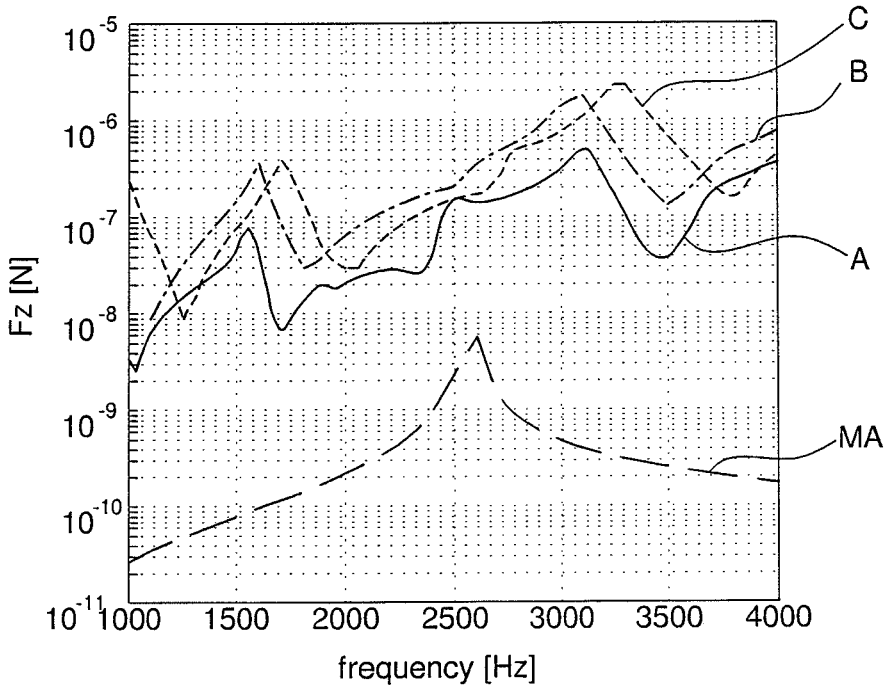
FIG. 3 shows a graph of the total force applied to the air by the membrane according to the invention compared to a circular membrane, according to the excitation frequency of the membrane.

FIG. 3 shows a graph of the frequency response of the proposed membrane compared with the response of an ordinary circular membrane made of the same material. The total force Fz applied by the membrane to the air is shown, according to the excitation frequency of the membrane. The circular membrane may be flat in this example and have a diameter on the order of 31 mm. The same excitation force has been applied in all of the cases considered.

The curve MA represents the response of an ordinary circular membrane (force of the membrane on the air) in the frequency range of 1 kHz to 4 kHz. It is noted that the force of this ordinary membrane on the air only has a greatest amplitude peak between 2.5 kHz and 3 kHz with relatively low overall amplitude. Curve A represents the response of a circular membrane, in which a centred ellipse is made, having a semi-major axis equal to 15 mm and semi-minor axis equal to 9 mm with a thickness of 0.07 mm and a non-centred ellipse, having a semi-major axis equal to 13.5 mm and semi-minor axis equal to 10 mm with a thickness of 0.09 mm. Curve B represents the response of a circular membrane, in which a centred ellipse is made, having a semi-major axis equal to 14 mm and a semi-minor axis equal to 10 mm with a thickness of 0.08 mm and a non-centred ellipse, having a semi-major axis equal to 12 mm and a semi-minor axis equal to 11 mm with a thickness of 0.1 mm. Finally, curve C represents the response of a circular membrane, in which a centred ellipse is made, having a semi-major axis equal to 15 mm and semi-minor axis equal to 9 mm with a thickness of 0.09 mm and a centred ellipse having a semi-major axis equal to 13.5 mm and semi-minor axis equal to 10 mm with a thickness of 0.11 mm. The amplitude of force applied to the air by the membrane, in which ellipses are made, is maximised and relatively flattened for natural vibration frequencies of between 1 kHz and 4 kHz, which is an object of the invention.

Figure 4:
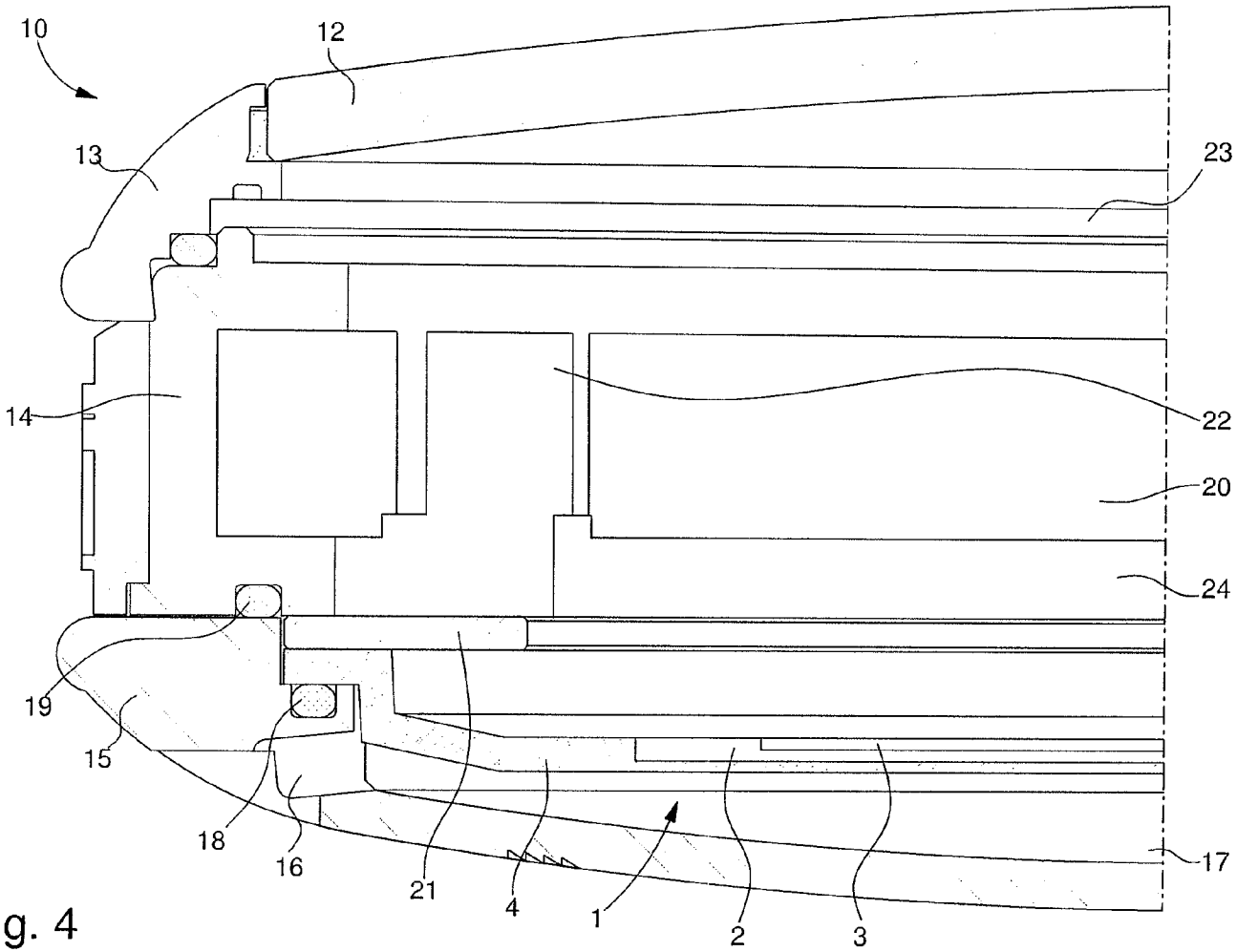
FIG. 4 shows a simplified, partial cross-section of a striking or musical watch, which is provided with an acoustic membrane according to the invention.

FIG. 4 thus shows a partial cross-section of a striking or musical watch 10. Watch 10 essentially includes an acoustic radiating membrane 1 according to the invention, for improving the acoustic efficiency of a note or notes produced by a striking mechanism. This acoustic membrane 1 may include two areas of elliptical shape 2 and 3, hollowed out of the bottom 4 of the membrane. This acoustic membrane may be made, for example, of an amorphous metal or metallic glass, which is a corrosion resistant material. The total thickness of membrane 1 may be less than or equal to 1 mm and preferably close to 0.3 mm.

Striking or musical watch 10 also includes a watch movement 20, which is generally mounted on a plate 24. An edge part 22 is secured to plate 24, which defines a watch frame. Usually, both plate 24 and the edge part 22 are made of a metallic material.

The watch movement 20 includes a striking mechanism which is not shown. This striking mechanism may include at least one gong mounted on a gong-carrier integral with plate 24, and at least one rotatably mounted hammer on the plate for striking said gong at determined times. The generally circular gong surrounds the various parts of the watch movement of the striking watch. This striking mechanism is provided for indicating a programmed alarm time or minute repeaters.

In a more elaborate musical watch embodiment, the striking mechanism may include a pin-barrel with a set of tongues connected to a heel, which is secured to plate 24. A musical note or succession of notes is produced by the vibrating tongues of the pin-barrel. Each tongue is normally configured to produce one particular note, but there may be some groups of two tongues so that each group produces the same particular note. To produce music, for example at programmed times, the pin-barrel tongues are raised and then released by pins integral with a rotating disc or cylinder on plate 24. Each actuated tongue mainly oscillates at its first natural frequency. The vibrations generated by the actuated tongues are transmitted to the exterior parts of the watch, which must allow the sound produced by each vibrating tongue to radiate acoustically.

In this embodiment, the acoustic membrane 1 is in the shape of a dome, the top edge of which is mounted, in a sealed manner via an annular gasket 18, on an inner annular edge of back cover 15 of the case. The diameter of this dome, which may be the same as the diameter of watch glass 12, may be between 20 and 40 mm. An annular shaped support 21 supports plate 24 on one side with edge part 22 and rests on the top edge of acoustic membrane 1. When middle part 14 is secured to back cover 15 of the watch case, support 21 and the peripheral edge of acoustic radiating membrane 1 are clamped between middle part 14 and the edge of back cover 15.

It is to be noted that it is possible for acoustic membrane 1 to be fixed via the edge thereof in a different manner to that presented hereinbefore. It is possible to envisage fixing the membrane at odd points, in 2, 3, 4 or more places via the edge thereof, or elastically or with one simple support condition.

Back cover 15 is removably mounted by known means on middle part 14 with a sealing gasket 19. A watch crystal 12 is secured notably to bezel 13 to close the watch case in a sealed manner. A dial 23 is held on the edge of the middle part and arranged below watch crystal 12. For a mechanical striking watch 10, time indicating hands, which are not shown, are provided on the dial, which generally also carries hour symbols on the periphery thereof.

The central part of the acoustic membrane is not in contact with support 21 and the inner surface of back cover 15. Consequently, a sufficient space 17 is provided in the case for the acoustic membrane to be able to vibrate freely or radiate acoustically. Acoustic membrane 1 and back cover 15 thus together form a double back cover. One or several apertures 16 are also provided laterally through back cover 15 to allow the acoustic membrane to radiate the sound produced by the striking mechanism towards the exterior.

During operation of the striking mechanism, the note or notes produced by said striking mechanism are transmitted straight to the acoustic membrane to make it vibrate. Connecting parts 21, 22 and 24 also transmit vibration to the acoustic membrane 1 at the edge thereof. Since the acoustic membrane includes areas of elliptical shape 2, 3 hollowed out of bottom 4 of the membrane, it is capable of vibrating at several first natural frequencies according to the number of notes to be radiated. These first natural frequencies are preferably within the useful acoustic band between 1 kHz and 4 kHz. The second natural vibration frequencies of the notes are, however, higher than 4 kHz. This is advantageous since the second vibration frequencies are often sound destructive.

These desired natural acoustic vibration frequencies of the membrane which may be made of amorphous metal, are dependent upon physical properties, such as density and the Young's modulus. Moreover, with this type of acoustic radiating membrane 1, very low level damping is observed, which provides a very high level of acoustic efficiency for the acoustic membrane. Moreover, the destructive interfering effect of the second natural frequencies is mitigated, given that a second natural frequency mode is generally close in frequency to a first natural frequency mode having orthogonal orientation. In other words, the membrane never vibrates on a pure second natural frequency mode.

Owing to the fact that this membrane is made of corrosion resistant materials, it can be mounted on a back cover, made, for example, of precious metal, such as gold. There is no difference in electrochemical potential observed even in a humid environment, which means that no corrosion occurs on contact between membrane 1 and back cover 15.

The metallic glass or amorphous metal used, for example, to make the membrane, may also be a titanium, zirconium and beryllium based metal alloy. Thus, by way of more specific example, the amorphous metal alloy may include 41% zirconium, 14% titanium, 12% copper, 10% nickel and 23% beryllium. The Young's modulus of this alloy is 105 GPa and the limit of elasticity is 1.5 GPa. The amorphous metal alloy may also be formed of 57.5% platinum, 14.7% copper, 5.3% nickel and 22.5% phosphorus. The Young's modulus of this alloy, in this case, is 98 GPa and the limit of elasticity is 1.4 GPa.

From the description that has just been given, several variants of the acoustic radiating membrane for a music box or striking watch can be devised by those skilled in the art without departing from the scope of the invention defined by the claims. The acoustic membrane may be located in the middle part of a watch case with an aperture through the middle part for the sound radiation of the vibrating acoustic membrane. The acoustic membrane may be located on an external part of the watch case, but arranged on at least one aperture in the case so that the note or notes produced by the striking mechanism can cause the membrane to vibrate. Several acoustic membranes may be provided, arranged at several places inside the watch case or superposed on each other. The membrane may have a different shape from a circular shape, for example rectangular, and be flat. The membrane may include an area of elliptical shape on a first face and another elliptical area on a second opposite face of the membrane.

What is claimed is:

1. An acoustic radiating membrane for a music box or striking watch, wherein it is made with at least one area of circularly asymmetrical shape formed in the material of the membrane or with at least one area of circularly asymmetrical shape hollowed out of a part of the membrane or projecting from one part of the membrane, wherein the asymmetrical area or areas have the shape of an ellipse and wherein the areas of elliptical shape are hollowed out of the membrane with a different uniform thickness from each other and less than the thickness of one bottom part of the membrane.

2. The membrane according to claim 1, wherein it includes several areas of asymmetrical shape.

3. The membrane according to claim 1, wherein it includes at least two asymmetrical areas, each area being hollowed out of the membrane with a different uniform thickness, to maximise the first natural vibration frequencies of the membrane within the frequency range between 1 kHz and 4 kHz.

4. The membrane according to claim 1, wherein the membrane has a general shape of a dome with a bottom in which the areas of elliptical shape are made.

5. The membrane according to claim 1, wherein a first area of elliptical shape is centred on the circular membrane, and wherein a second area of elliptical shape is off centre on the membrane, and wherein the two areas are partly superposed.

6. The membrane according to claim 5 wherein the ratio between the semiaxes of the two ellipses hollowed out of the membrane and the radius of the circular membrane must be comprised within the range of ⅔ to 1, wherein the ratio between the two thicknesses of the ellipses must be within the range of ½ to ⅘,and wherein the minimum thickness of each ellipse must not be greater than ⅔ of the total thickness of the circular membrane.

7. The membrane according to claim 2, wherein the uniform thickness of the membrane is 0.3 mm or less, wherein the thickness of a first area of elliptical shape is on the order of 0.15 mm and wherein the thickness of the second area of elliptical shape is on the order of 0.2 mm.

8. The membrane according to claim 1, wherein it is made of gold or titanium or amorphous metal or metallic glass.

9. The membrane according to claim 1, wherein the area of asymmetrical shape is formed in the basic material of the membrane by altering the physico-chemical properties of the material locally and in a deterministic manner.

10. A striking or musical watch, including a watch case, which has a middle part and a back cover having at least one lateral aperture, wherein the back cover is secured in a sealed and removable manner to the middle part, a crystal closing the case in a sealed manner, a watch movement held inside the watch case and provided with a striking mechanism capable of being actuated at determined times to produce one note or several notes, and at least one acoustic radiating membrane made with at least one area of circularly asymmetrical shape formed in the material of the membrane or with at least one area of circularly asymmetrical shape hollowed out of a part of the membrane or projecting from one part of the membrane, which is arranged in the watch case, wherein the acoustic membrane has the shape of a dome, whose top edge is clamped with the annular support between the middle part and an inner annular edge of the back cover of the case, an annular sealing gasket being placed between the edge of the back cover and the annular edge of the membrane. and wherein a central part of the acoustic membrane is with the support and an inner surface of the back cover of the case to define a space allowing said membrane to oscillate freely.

11. A watch according to claim 10, wherein the acoustic membrane, is held on an inner edge of the back cover of the case and one part of the middle part, and wherein the periphery of the acoustic membrane is clamped with the periphery of a support of the movement between the middle part and the inner edge of the back cover of the case.

12. A watch according to claim 10, wherein several acoustic radiating membranes are connected to the watch case and arranged separately from each other or superposed on each other.

13. An acoustic radiating membrane for a music box or striking watch, wherein it is made with at least one area of circularly asymmetrical shape formed in the material of the membrane or with at least one area of circularly asymmetrical shape hollowed out of a part of the membrane or projecting from one part of the membrane, wherein the asymmetrical area or areas have the shape of an ellipse, wherein the asymmetrical area or areas have the shape of an ellipse, wherein the areas of elliptical shape are projecting portions made on a minimum thickness of the membrane, each elliptical area having a different thickness from the other.

14. The membrane according to claim 13, wherein the membrane has a general shape of a dome with a bottom in which the areas of elliptical shape are made.

15. The membrane according to claim 13, wherein a first area of elliptical shape is centred on the circular membrane, and wherein a second area of elliptical shape is off centre on the membrane, and wherein the two areas are partly superposed.

* * * * *